US008302413B2

(12) United States Patent
Kawano et al.

(10) Patent No.: US 8,302,413 B2
(45) Date of Patent: Nov. 6, 2012

(54) AIR CONDITIONER

(75) Inventors: Satoshi Kawano, Osaka (JP); Shinya Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 681 days.

(21) Appl. No.: 12/524,007

(22) PCT Filed: Jan. 23, 2008

(86) PCT No.: PCT/JP2008/050904

§ 371 (c)(1),
(2), (4) Date: Jul. 22, 2009

(87) PCT Pub. No.: WO2008/090927

PCT Pub. Date: Jul. 31, 2008

(65) Prior Publication Data

US 2010/0101256 A1 Apr. 29, 2010

(30) Foreign Application Priority Data

Jan. 23, 2007 (JP) ..... 2007-012696

(51) Int. Cl.
*F25B 13/00* (2006.01)
*F25B 29/00* (2006.01)
*F25B 49/00* (2006.01)

(52) U.S. Cl. ..... 62/159; 62/196.1; 62/200; 62/225; 62/324.6

(58) Field of Classification Search ..... 62/113, 62/159, 160, 196.1, 199, 200, 225, 324.6, 62/513
See application file for complete search history.

(56) References Cited

U.S. PATENT DOCUMENTS

| | | | | |
|---|---|---|---|---|
| 6,865,904 | B2 | 3/2005 | Wang | |
| 8,091,377 | B2 * | 1/2012 | Jeong et al. | 62/324.6 |
| 2005/0150243 | A1 | 7/2005 | Matsuoka et al. | |
| 2006/0137381 | A1 * | 6/2006 | Choi et al. | 62/324.1 |

FOREIGN PATENT DOCUMENTS

| | | | |
|---|---|---|---|
| JP | 6-265232 | A | 9/1994 |
| JP | 10-38413 | A | 2/1998 |
| JP | 11-241844 | A | 9/1999 |
| JP | 2004-347269 | A | 12/2004 |
| KR | 10-2004-0045797 | A | 6/2004 |
| WO | WO-03/087681 | A1 | 10/2003 |

* cited by examiner

*Primary Examiner* — Marc Norman
(74) *Attorney, Agent, or Firm* — Birch, Stewart, Kolasch & Birch, LLP

(57) ABSTRACT

Out of switching mechanisms (30A, 30B), the switching mechanism (30A) connected to an indoor heat exchanger (41) performing a heating operation is configured so that the opening of a supercooling control valve (53) is adjusted according to the air conditioning load of another indoor heat exchanger (41) performing a cooling operation downstream of a liquid connection pipe (13) connected to the former indoor heat exchanger (41).

3 Claims, 5 Drawing Sheets

AIR CONDITIONER

TECHNICAL FIELD

This invention relates to air conditioners and particularly relates to prevention of noise due to refrigerant flow sound caused by occurrence of a flash in a refrigerant pipe.

BACKGROUND ART

Conventionally, a refrigerant circuit such as in an air conditioner includes various control valves including a solenoid valve for shutting off the flow of refrigerant and a check valve for permitting the flow of refrigerant only in a single direction. For example, an air conditioner disclosed in Patent Document 1 includes an outdoor unit and a plurality of indoor units. Between the outdoor unit and each of the indoor units is connected a BS unit as an intermediate unit for switching between refrigerant flow paths.

The BS unit has a refrigerant pipe structure in which a plurality of on-off valves and the like are provided. The BS unit is configured to be switchable, with the switching of each on-off valve, between a state in which refrigerant evaporated in the associated indoor unit flows into the BS unit and flows out towards a compressor in the outdoor unit, and a state in which refrigerant discharged from the compressor in the outdoor unit flows into the BS unit and flows out towards the associated indoor unit. Thus, the indoor units can be individually switched between cooling and heating operations.

Patent Document 1: Published Japanese Patent Application No. H11-241844

DISCLOSURE OF THE INVENTION

Problems to be Solved by the Invention

In air conditioners of this kind, liquid refrigerant flows out of the indoor unit performing a heating operation into a liquid connection pipe connected to the downstream side of the indoor unit. The liquid refrigerant may cause a flash in the liquid connection pipe to turn into a gas-liquid two-phase state.

If the refrigerant thus turned into a gas-liquid two-phase state flows into another indoor unit performing a cooling operation downstream of the indoor unit during the heating operation, sound of refrigerant flowing therethrough (refrigerant flow sound) occurs. Furthermore, a required performance for a cooling operation may not be able to be exhibited. Specifically, if a plurality of indoor units performing cooling operations are connected and have different preset temperatures, there may occur a phenomenon that a large amount of refrigerant is fed to an indoor unit requiring a higher cooling capacity but a less amount of refrigerant is fed to the other indoor units, i.e., a so-called maldistribution of flow.

To solve these problems, it is conceivable to provide a supercooling circuit for supercooling liquid refrigerant flowing through the liquid connection pipe into a totally liquid-phase refrigerant. A conventional supercooling circuit is known which includes a supercooling heat exchanger, a supercooling pipe branching from the liquid connection pipe passing through the supercooling heat exchanger, a solenoid valve for selectively allowing or shutting off the flow of refrigerant into the supercooling pipe, and a capillary tube for reducing the pressure of refrigerant flowing through the supercooling pipe.

In the supercooling circuit, refrigerant diverted from the liquid connection pipe is reduced in pressure by the capillary tube and evaporates in the supercooling heat exchanger, whereby liquid refrigerant flowing through the liquid connection pipe is supercooled.

However, with the conventional supercooling circuit, a small operating capacity of the air conditioner as a whole, i.e., a small difference between high-side pressure at the discharge side of the compressor and low-side pressure at the suction side thereof, may cause the refrigerant to be insufficiently reduced in pressure by the capillary tube. As a result, no pressure difference may be provided between the refrigerant flowing through the liquid connection pipe and the refrigerant flowing through the supercooling pipe. In this case, the liquid refrigerant flowing through the liquid connection pipe cannot sufficiently be supercooled. Thus, the refrigerant in a gas-liquid two-phase state may flow into the other indoor unit performing a cooling operation downstream of the indoor unit during a heating operation, thereby causing sound of refrigerant flowing therethrough (refrigerant flow sound) and inhibiting the other indoor unit from exhibiting a required performance for the cooling operation.

The present invention has been made in view of the foregoing points and, therefore, an object thereof is to ensure the air conditioning performance of the air conditioner as a whole while suppressing refrigerant flow sound due to occurrence of a flash of refrigerant.

Means to Solve the Problems

A first aspect of the invention is directed to an air conditioner including a high-pressure gas connection pipe (11), a low-pressure gas connection pipe (12), a liquid connection pipe (13), and a plurality of utilization side heat exchangers (41, 41), one end of each of the utilization side heat exchangers (41, 41) being connected through a liquid pipe (40) of a switching mechanism (30A, 30B) and an expansion mechanism (42) to the liquid connection pipe (13), the other end of each of the utilization side heat exchangers (41, 41) being connected through the switching mechanism (30A, 30B) to the high-pressure gas connection pipe (11) and the low-pressure gas connection pipe (12) to be switchable between both the gas connection pipes, each of the utilization side heat exchangers (41, 41) being capable of performing a cooling operation and a heating operation individually, wherein each of the switching mechanisms (30A, 30B) comprises:

a supercooling heat exchanger (51) for supercooling liquid refrigerant flowing through the liquid pipe (40);

a supercooling pipe (52) connected at one end to the liquid pipe (40), passing through the supercooling heat exchanger (51) and connected at the other end to the low-pressure gas connection pipe (12); and a supercooling control valve (53) disposed in the supercooling pipe (52) between the one end of the supercooling pipe (52) and the supercooling heat exchanger (51) and being adjustable in opening, and out of the switching mechanisms (30A, 30B), the switching mechanism (30A) connected to the utilization side heat exchanger (41) performing a heating operation is configured so that the opening of the supercooling control valve (53) is adjusted according to the air conditioning load of the other utilization side heat exchanger (41) performing a cooling operation downstream of the liquid connection pipe (13) connected to the former utilization side heat exchanger (41).

According to the first aspect of the invention, in the switching mechanism (30A) connected to the utilization side heat exchanger (41) performing a heating operation out of the switching mechanisms (30A, 30B), the opening of the supercooling control valve (53) is adjusted according to the air conditioning load of the other utilization side heat exchanger (41) performing a cooling operation downstream of the liquid connection pipe (13) connected to the former utilization side heat exchanger (41).

Therefore, the liquid refrigerant can be supercooled to ensure the required cooling capacity of the other utilization side heat exchanger (41) performing a cooling operation downstream of the switching mechanism (30A) during a heating operation. Specifically, if comparison is made between the case where two utilization side heat exchangers (41) are disposed downstream of the switching mechanism (30A) during a heating operation and both of the two perform cooling operations, and the case where one of the same two utilization side heat exchangers (41) is activated and the other is deactivated, the former case involves a larger air conditioning load than the latter case. Therefore, when one of the two utilization side heat exchangers (41) is deactivated, it is desirable that the opening of the supercooling control valve (53) should be controlled to be smaller than when both of the two utilization side heat exchangers (41) perform cooling operations.

Thus, the liquid refrigerant can be prevented from causing a flash to suppress the occurrence of refrigerant flow sound, and the amount of liquid refrigerant flowing into the supercooling pipe (52) can be minimum, which ensures a sufficient amount of liquid refrigerant flowing into the downstream other utilization side heat exchanger (41).

Furthermore, the air conditioning load of each utilization side heat exchanger (41) varies depending upon the number of utilization side heat exchangers (41), the ambient temperature around the utilization side heat exchanger (41), and the preset temperature in the cooling operation. According to the first aspect of the invention, the supercooling temperature can be flexibly set according to the air conditioning load.

In a second aspect of the invention, out of the switching mechanisms (30A, 30B), the switching mechanism (30B) connected to the utilization side heat exchanger (41) performing a cooling operation is configured so that the opening of the supercooling control valve (53) is adjusted according to the air conditioning load of the relevant utilization side heat exchanger (41).

According to the second aspect of the invention, in the switching mechanism (30B) connected to the utilization side heat exchanger (41) performing a cooling operation out of the switching mechanisms (30A, 30B), the opening of the supercooling control valve (53) is adjusted according to the air conditioning load of the relevant utilization side heat exchanger (41).

Therefore, the liquid refrigerant can be supercooled to ensure the required cooling capacity of the utilization side heat exchanger (41) connected downstream of the switching mechanism (30B) during a cooling operation. Specifically, if comparison is made between the case where two utilization side heat exchangers (41) are connected downstream of the switching mechanism (30B) during a cooling operation and both of the two perform cooling operations, and the case where one of the same two utilization side heat exchangers (41) is activated and the other is deactivated, the former case involves a larger air conditioning load than the latter case. Therefore, when one of the two utilization side heat exchangers (41) is deactivated, it is desirable that the opening of the supercooling control valve (53) should be controlled to be smaller than when both of the two utilization side heat exchangers (41) perform cooling operations.

Thus, the liquid refrigerant can be prevented from causing a flash to suppress the occurrence of refrigerant flow sound, and the amount of liquid refrigerant flowing into the supercooling pipe (52) can be minimum, which ensures a sufficient amount of liquid refrigerant flowing into the downstream utilization side heat exchanger (41).

In a third aspect of the invention, the air conditioner further includes a temperature detection means (45) configured to detect the temperature of refrigerant in the supercooling pipe (52) downstream of the supercooling heat exchanger (51), wherein each of the switching mechanisms (30A, 30B) is configured so that the opening of the supercooling control valve (53) is adjusted according to the detected value of the temperature detection means (45).

According to the third aspect of the invention, in each of the switching mechanisms (30A, 30B), the opening of the supercooling control valve (53) is adjusted according to the detected value of the temperature detection means (45). Therefore, the refrigerant flow rate can be controlled by appropriately adjusting the opening of the supercooling control valve (53) so that the liquid refrigerant diverted from the liquid pipe (40) into the supercooling pipe (52) can surely evaporate in the supercooling heat exchanger (51). This is advantageous in preventing that the liquid refrigerant flowing through the supercooling pipe (52) cannot fully evaporate in the supercooling heat exchanger (51) and thereby turns into a gas-liquid two-phase state, and that in turn the refrigerant in a gas-liquid two-phase state flows into the compressor (21) to burn out the compressor (21).

Effects of the Invention

According to the present invention, the liquid refrigerant can be supercooled to ensure the required cooling capacity of the other utilization side heat exchanger (41) performing a cooling operation. Specifically, if comparison is made between the case where two utilization side heat exchangers (41) are disposed downstream of the switching mechanism (30A) during a heating operation and both of the two perform cooling operations, and the case where one of the same two utilization side heat exchangers (41) is activated and the other is deactivated, the former case involves a larger air conditioning load than the latter case. Therefore, when one of the two utilization side heat exchangers (41) is deactivated, it is desirable that the opening of the supercooling control valve (53) should be controlled to be smaller than when both of the two utilization side heat exchangers (41) perform cooling operations.

Thus, the liquid refrigerant can be prevented from causing a flash to suppress the occurrence of refrigerant flow sound, and the amount of liquid refrigerant flowing into the supercooling pipe (52) can be minimum, which ensures a sufficient amount of liquid refrigerant flowing into the downstream other utilization side heat exchanger (41).

Furthermore, the air conditioning load of each utilization side heat exchanger (41) varies depending upon the number of utilization side heat exchangers (41), the ambient temperature around the utilization side heat exchanger (41), and the preset temperature in the cooling operation. According to the present invention, the supercooling temperature can be flexibly set according to the air conditioning load.

According to the second aspect of the invention, the liquid refrigerant can be supercooled to ensure the required cooling capacity of the utilization side heat exchanger (41) connected downstream of the switching mechanism (30B) during a cooling operation. Specifically, if comparison is made between the case where two utilization side heat exchangers (41) are connected downstream of the switching mechanism (30B) during a cooling operation and both of the two perform cooling operations, and the case where one of the same two utilization side heat exchangers (41) is activated and the other is deactivated, the former case involves a larger air conditioning load than the latter case. Therefore, when one of the two utilization side heat exchangers (41) is deactivated, it is desirable that the opening of the supercooling control valve (53) should be controlled to be smaller than when both of the two utilization side heat exchangers (41) perform cooling operations.

Thus, the liquid refrigerant can be prevented from causing a flash to suppress the occurrence of refrigerant flow sound, and the amount of liquid refrigerant flowing into the supercooling pipe (52) can be minimum, which ensures a sufficient amount of liquid refrigerant flowing into the downstream utilization side heat exchanger (41).

According to the third aspect of the invention, the refrigerant flow rate can be controlled by appropriately adjusting the opening of the supercooling control valve (53) so that the liquid refrigerant diverted from the liquid pipe (40) into the supercooling pipe (52) can surely evaporate in the supercooling heat exchanger (51). This is advantageous in preventing that the liquid refrigerant flowing through the supercooling pipe (52) cannot fully evaporate in the supercooling heat exchanger (51) and thereby turns into a gas-liquid two-phase state, and that in turn the refrigerant in a gas-liquid two-phase state flows into the compressor (21) to burn out the compressor (21).

LIST OF REFERENCE NUMERALS

Figure 1:
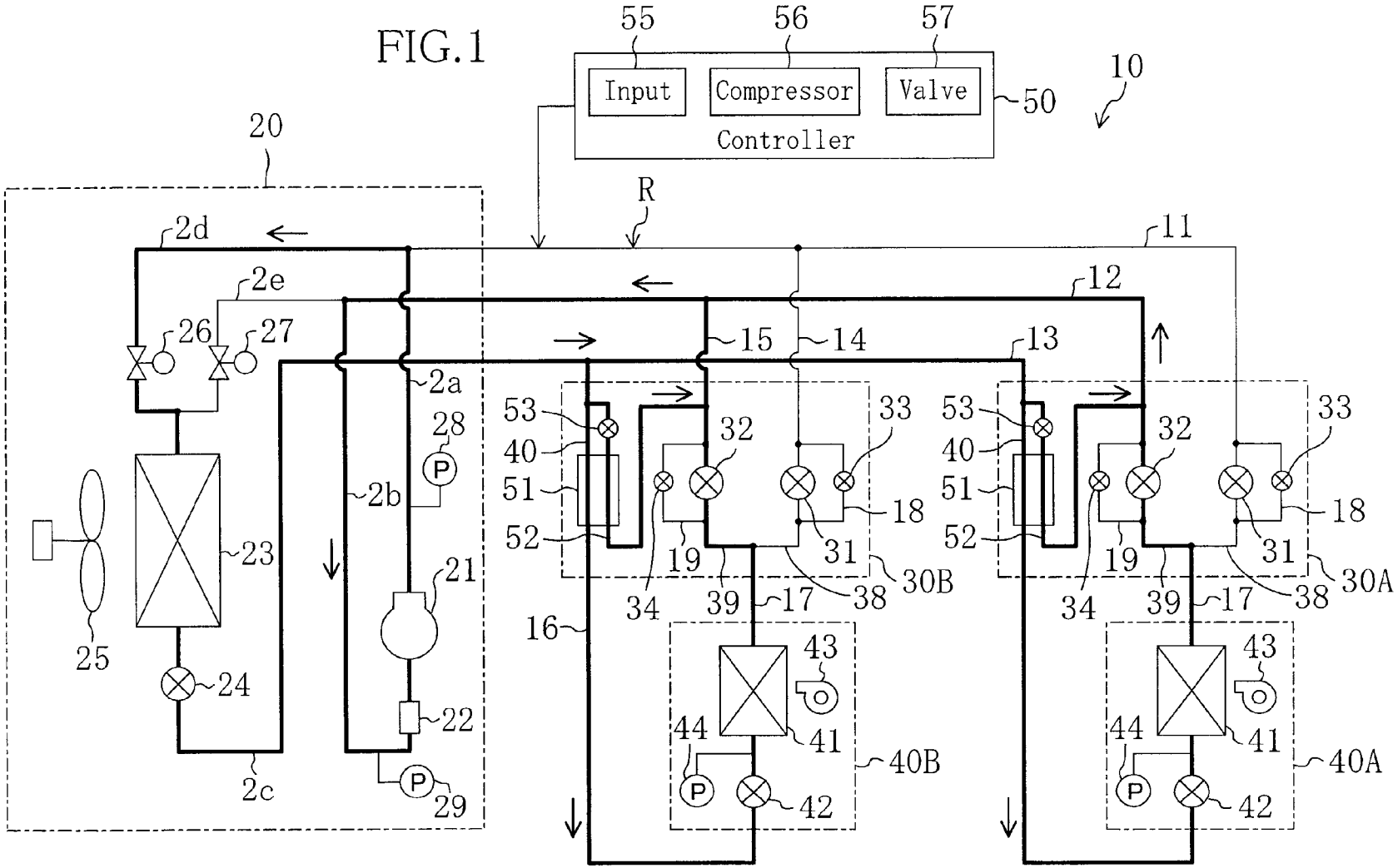
FIG. 1 is a refrigerant circuit diagram showing a general configuration of an air conditioner according to an embodiment and showing the performance of a cooling operation.

10 air conditioner
11 high-pressure gas connection pipe
12 low-pressure gas connection pipe
13 liquid connection pipe
18 first bypass pipe
19 second bypass pipe
21 compressor
30 air conditioner
30A first BS unit (switching mechanism)
30B second BS unit (switching mechanism)
31 first control valve
32 second control valve
40 liquid pipe
41 indoor heat exchanger (utilization side heat exchanger)
42 indoor expansion valve (expansion mechanism)
45 temperature sensor (temperature detection means)
51 supercooling heat exchanger
52 supercooling pipe
53 supercooling control valve

BEST MODE FOR CARRYING OUT THE INVENTION

Embodiments of the present invention will be described below with reference to the drawings. The following description of preferred embodiments is merely illustrative in nature and is not intended to limit the scope, applications and use of the invention.

As shown in FIG. 1, an air conditioner (10) according to an embodiment is installed such as in a building, and used to cool and heat rooms in the building. The air conditioner (10) includes an outdoor unit (20), two BS units (30A, 30B) serving as switching mechanisms, and two indoor units (40A, 40B). These units including the outdoor unit (20) and the other units are connected by connection pipes serving as refrigerant pipes to constitute a refrigerant circuit (R). The refrigerant circuit (R) operates in a vapor compression refrigeration cycle by circulating refrigerant therethrough.

The outdoor unit (20) constitutes a heat-source unit in this embodiment. The outdoor unit (20) includes a main pipe (2*c*), a first branch pipe (2*d*) and a second branch pipe (2*e*), all of which are refrigerant pipes. The outdoor unit (20) further includes a compressor (21), an outdoor heat exchanger (23), an outdoor expansion valve (24), and two solenoid valves (26, 27).

The main pipe (2*c*) is connected at one end to a liquid connection pipe (13) that is a connection pipe disposed outside the outdoor unit (20), and connected at the other end to one ends of the first branch pipe (2*d*) and the second branch pipe (2*e*). The other end of the first branch pipe (2*d*) is connected to a high-pressure gas connection pipe (11) that is a connection pipe disposed outside the outdoor unit (20). The other end of the second branch pipe (2*e*) is connected to a low-pressure gas connection pipe (12) that is a connection pipe disposed outside the outdoor unit (20).

The compressor (21) is a fluid machine for compressing refrigerant, and is constituted by, for example, a high-pressure dome scroll compressor. A discharge pipe (2*a*) of the compressor (21) is connected to an intermediate point of the first branch pipe (2*d*), and a suction pipe (2*b*) thereof is connected to an intermediate point of the second branch pipe (2*e*). The suction pipe (2*b*) is provided with an accumulator (22).

The outdoor heat exchanger (23) is a cross-fin-and-tube heat exchanger, and is disposed at an intermediate point of the main pipe (2*c*). The outdoor expansion valve (24) is constituted by an electronic expansion valve, and disposed in the main pipe (2*c*) closer to the liquid connection pipe (13) than the outdoor heat exchanger (23). Disposed close to the outdoor heat exchanger (23) is an outdoor fan (25). The outdoor heat exchanger (23) is configured so that refrigerant therein exchanges heat with the air taken in by the outdoor fan (25).

The two solenoid valves (26, 27) mentioned above are a first solenoid valve (26) and a second solenoid valve (27). The first solenoid valve (26) is disposed in the first branch pipe (2*d*) closer to the outdoor heat exchanger (23) than the connection with the discharge pipe (2*a*). The second solenoid valve (27) is disposed in the second branch pipe (2*e*) closer to the outdoor heat exchanger (23) than the connection with the suction pipe (2*b*). These solenoid valves (26, 27) constitutes control valves each for selectively permitting or shutting off the flow of refrigerant.

Each of the indoor units (40A, 40B) constitutes a utilization unit in this embodiment. Each indoor unit (40A, 40B) is connected to the associated BS unit (30A, 30B) through an intermediate connection pipe (17) that is a connection pipe. In other words, the first indoor unit (40A) and the first BS unit (30A) are connected as a pair to each other, and the second indoor unit (40B) and the second BS unit (30B) are connected as a pair to each other. The first indoor unit (40A) is connected to the liquid connection pipe (13). The second indoor unit (40B) is connected to a branch liquid connection pipe (16) branching from the liquid connection pipe (13).

Each indoor unit (40A, 40B) includes an indoor heat exchanger (41) and an indoor expansion valve (42) that are connected to each other through a refrigerant pipe. The indoor heat exchanger (41) is connected to the intermediate connection pipe (17). The indoor expansion valve (42) of the first indoor unit (40A) is connected to the liquid connection pipe (13), whereas the indoor expansion valve (42) of the second indoor unit (40B) is connected to the branch liquid connection pipe (16). The indoor heat exchanger (41) is a cross-fin-and-tube heat exchanger. The indoor expansion valve (42) is constituted by an electronic expansion valve. Disposed close to the indoor heat exchanger (41) is an indoor fan (43). The indoor heat exchanger (41) is configured so that refrigerant therein exchanges heat with the air taken in by the indoor fan (43).

The first BS unit (30A) is connected to the intermediate connection pipe (17) and also to the high-pressure gas connection pipe (11) and the low-pressure gas connection pipe (12). In the first BS unit (30A), the intermediate connection pipe (17) and the high-pressure gas connection pipe (11) constitute a high-pressure passage (38), whereas the intermediate connection pipe (17) and the low-pressure gas connection pipe (12) constitute a low-pressure passage (39). The high-pressure passage (38) and the low-pressure passage (39) join and are connected to each other. Furthermore, in the first BS unit (30A), the high-pressure gas connection pipe (11) constituting part of the high pressure passage (38) is provided with a first control valve (31) adjustable in opening, whereas the low-pressure gas connection pipe (12) constituting part of the low-pressure passage (39) is provided with a second control valve (32) adjustable in opening.

The high-pressure passage (38) is connected to a first bypass passage (18) bypassing the first control valve (31), whereas the low-pressure passage (39) is connected to a second bypass passage (19) bypassing the second control valve (32). The first and second bypass pipes (18, 19) are formed with smaller inside diameters than the high-pressure gas connection pipe (11) and the low-pressure gas connection pipe (12), respectively. The first and second bypass pipes (18, 19) are provided with first and second sub-control valves (33, 34), respectively, that are adjustable in opening and have smaller refrigerant flow rates at their fully open positions than the first and second control valves (31, 32), respectively. The liquid connection pipe (13) passes through the first BS unit (30A) to constitute a liquid pipe (40).

The first BS unit (30A) includes a supercooling heat exchanger (51) and a supercooling pipe (52) both of which constitute a supercooling circuit. The supercooling heat exchanger (51) is used in order to supercool liquid refrigerant flowing through the liquid connection pipe (13) constituting the liquid pipe (40). The supercooling pipe (52) is connected at one end to the liquid pipe (40), passes through the supercooling heat exchanger (51), and is then connected at the other end to the low-pressure gas connection pipe (12).

Furthermore, a supercooling control valve (53) adjustable in opening is disposed in the supercooling pipe (52) between the one end of the supercooling pipe (52) and the supercooling heat exchanger (51). By adjusting the opening of the supercooling control valve (53), the amount of liquid refrigerant flowing into the supercooling circuit is controlled. As will be more fully described hereinafter, the opening of the supercooling control valve (53) is adjusted by a controller (50) according to the air conditioning load of the downstream indoor heat exchanger (41) during a cooling operation.

The liquid refrigerant flowing through the supercooling pipe (52) is reduced in pressure by the supercooling control valve (53), exchanges heat with the liquid refrigerant flowing though the liquid pipe (40) in the supercooling heat exchanger (51) to evaporate, and is then recovered through the low-pressure gas connection pipe (12).

The second BS unit (30B) is connected to the intermediate connection pipe (17), and also connected to a branch high-pressure gas connection pipe (14) branching from the high-pressure gas connection pipe (11), and a branch low-pressure gas connection pipe (15) branching from the low-pressure gas connection pipe (12). Furthermore, in the second BS unit (30B), the branch high-pressure gas connection pipe (14) constituting part of a high pressure passage (38) is provided with a first control valve (31), whereas the branch low-pressure gas connection pipe (15) constituting part of a low-pressure passage (39) is provided with a second control valve (32).

The branch high-pressure gas connection pipe (14) is connected to a first bypass passage (18) bypassing the first control valve (31), whereas the branch low-pressure gas connection pipe (15) is connected to a second bypass passage (19) bypassing the second control valve (32). The first and second bypass pipes (18, 19) have smaller inside diameters than the branch high-pressure gas connection pipe (14) and the branch low-pressure gas connection pipe (15), respectively. The first and second bypass pipes (18, 19) are provided with first and second sub-control valves (33, 34), respectively, that have smaller refrigerant flow rates at their fully open positions than the first and second control valves (31, 32), respectively. The branch liquid connection pipe (16) passes through the second BS unit (30B) to constitute a liquid pipe (40).

The second BS unit (30B) includes a supercooling heat exchanger (51) and a supercooling pipe (52) both of which constitute a supercooling circuit. The supercooling heat exchanger (51) is used in order to supercool liquid refrigerant flowing through the branch liquid connection pipe (16) constituting the liquid pipe (40). The supercooling pipe (52) is connected at one end to the liquid pipe (40), passes through the supercooling heat exchanger (51), and is then connected at the other end to the branch low-pressure gas connection pipe (15).

Furthermore, a supercooling control valve (53) adjustable in opening is disposed in the supercooling pipe (52) between the one end of the supercooling pipe (52) and the supercooling heat exchanger (51). By adjusting the opening of the supercooling control valve (53), the amount of liquid refrigerant flowing into the supercooling circuit is controlled.

The first and second control valves (31, 32) and the first and second sub-control valves (33, 34) in each BS unit (30A, 30B) constitute electric motor-operated valves each for controlling the refrigerant flow rate by adjusting the opening. These first and second control valves (31, 32) and first and second sub-control valves (33, 34) are used in order to switch between cooling and heating operations in each indoor unit (40A, 40B) by changing the refrigerant flow path by switching between their open and closed positions.

For example, when the indoor unit (40A, 40B) is in a cooling operation, the first control valve (31) is set to a closed position, and the second control valve (32) is set to an open position. Thus, refrigerant having evaporated in the indoor heat exchanger (41) flows into the low-pressure gas connection pipe (12). On the other hand, when the indoor unit (40A, 40B) is in a heating operation, the first control valve (31) is set to an open position, and the second control valve (32) is set to a closed position. Thus, gas refrigerant flows through the high-pressure gas connection pipe (11) into the indoor heat exchanger (41) to condense (release heat) therein.

The air conditioner (10) is provided with various pressure sensors (28, 29, 44). Specifically, the discharge pipe (2*a*) of the compressor (21) is provided with a discharge pressure sensor (28) for detecting the discharge pressure of the compressor (21). The suction pipe (2*b*) of the compressor (21) is provided, upstream of the accumulator (22), with a suction pressure sensor (29) for detecting the suction pressure of the compressor (21). Between the indoor heat exchanger (41) and the indoor expansion valve (42) is provided a heat exchange pressure sensor (44) for detecting the pressure of the indoor heat exchanger (41).

The air conditioner (10) further includes a controller (50). The controller (50) constitutes an opening control means that performs a pressure equalizing operation in switching at least one of the indoor units (40A, 40B) between cooling and heating operations. The pressure equalizing operation is implemented by controlling the first and second control valves (31, 32) to equalize, in switching from cooling to heating operation, the pressure of the indoor heat exchanger (41) with that of the high-pressure gas connection pipe (11), and to equalize, in switching from heating to cooling operation, the pressure of the indoor heat exchanger (41) with that of the low-pressure gas connection pipe (12).

The pressure equalizing operation in switching from cooling to heating operation will be more fully described below. Note that the following first control valve (31), second control valve (32), indoor expansion valve (42) and the like are those in the second BS unit (30B) and the second indoor unit (40B).

First, the second control valve (32) and the second sub-control valve (34) are closed. Thus, the flow of refrigerant into the second BS unit (30B) and the second indoor unit (40B) is shut off.

Next, the first sub-control valve (33) is slightly opened. Thus, the refrigerant discharged from the compressor (21) flows little by little via the branch high-pressure gas connection pipe (14), the first bypass pipe (18) and the intermediate connection pipe (17) into the indoor heat exchanger (41) being in a low-pressure state. As a result, the indoor heat exchanger (41) and the like being in a low-pressure state are gradually equalized to a high-pressure state equal to that of the branch high-pressure gas connection pipe (14).

Next, the first control valve (31) is fully opened. The first sub-control valve (33) may remain in an open position or may be controlled to be closed upon opening of the first control valve (31).

Thus, the refrigerant discharged from the compressor (21) flows via the branch high-pressure gas connection pipe (14), the first bypass pipe (18) and the intermediate connection pipe (17) into the indoor heat exchanger (41), thereby completing the switching from cooling to heating operation.

On the other hand, in switching from heating to cooling operation, the first control valve (31) and the first sub-control valve (33) are first closed. Thus, the flow of refrigerant into the second BS unit (30B) and the second indoor unit (40B) is shut off.

Next, the second sub-control valve (34) is slightly opened. Thus, the refrigerant discharged from the compressor (21) flows little by little via the indoor heat exchanger (41), the intermediate connection pipe (17) and the second bypass pipe (19) into the branch low-pressure gas connection pipe (15). As a result, the indoor heat exchanger (41) and the like being in a high-pressure state are gradually equalized to a low-pressure state equal to that of the branch low-pressure gas connection pipe (15).

Next, the second control valve (32) is fully opened. The second sub-control valve (34) may remain in an open position or may be controlled to be closed upon opening of the second control valve (32).

Thus, the refrigerant discharged from the compressor (21) flows via the indoor heat exchanger (41), the intermediate connection pipe (17) and the second bypass pipe (19) into the branch low-pressure gas connection pipe (15), thereby completing the switching from heating to cooling operation.

The controller (50) also constitutes an opening control means that, when downstream of the indoor unit (40A, 40B) performing a heating operation is another indoor unit (40A, 40B) performing a cooling operation, adjusts the openings of the supercooling control valves (53) of the first and second BS units (30A, 30B) according to the air conditioning load of the indoor unit (40A, 40B) performing the cooling operation. The details of the supercooling operation will be described hereinafter.

The controller (50) includes a pressure input section (55), a compressor control section (56), and a valve operating section (57).

The pressure input section (55) receives, in the pressure equalizing operation, the detected pressures of the discharge pressure sensor (28), the suction pressure sensor (29) and the heat exchange pressure sensor (44). The valve operating section (57) adjusts, in the pressure equalizing operation, the openings of the first and second control valves (31, 32), the first and second sub-control valves (33, 34) and the supercooling control valve (53).

The compressor control section (56) constitutes a pressure control means that, in the pressure equalizing operation, controls the entrance pressures of the first and second control valves (31, 32) to have predetermined values or more. The entrance pressure of the first control valve (31) as used herein means the pressure of refrigerant flowing from the discharge pipe (2*a*) of the compressor (21) into the first control valve (31). The entrance pressure of the second control valve (32) as used herein means the pressure of refrigerant flowing from the indoor heat exchanger (41) into the second control valve (32).

In this embodiment, the detected pressures of the heat exchange pressure sensors (44) are used as the entrance pressures of the first and second control valves (31, 32). If the heat exchange pressure sensor (44) cannot detect the pressure owing to a failure or the like, the detected pressure of the discharge pressure sensor (28) is used instead as the entrance pressure of the first control valve (31), whereas the detected pressure of the suction pressure sensor (29) is used instead as the entrance pressure of the second control valve (32).

-Operations-

Next, the operations of the air conditioner (10) will be described with reference to the drawings. The operations of the air conditioner (10) include operations in which both of the two indoor units (40A, 40B) cool rooms or heat rooms, and an operation in which one of the two cools a room and the other heats a room.

<Cooling Operation>

With reference to FIG. 1, first will be described the operation in which both of the first indoor unit (40A) and the second indoor unit (40B) cool rooms. In this cooling operation, in the outdoor unit (20), the first solenoid valve (26) is set to an open position, the second solenoid valve (27) is set to a closed position, and the outdoor expansion valve (24) is set to a fully open position. In each BS unit (30A, 30B), the first control valve (31) and the first and second sub-control valves (33, 34) are set to closed positions, and the second control valve (32)

is set to an open position. In each indoor unit (40A, 40B), the indoor expansion valve (42) is set to an appropriate opening.

When the compressor (21) is driven under the above conditions, high-pressure gas refrigerant discharged from the compressor (21) flows through the first branch pipe (2*d*) into the outdoor heat exchanger (23). In the outdoor heat exchanger (23), the refrigerant exchanges heat with the air taken in by the outdoor fan (25) to condense. The refrigerant having condensed flows through the main pipe (2*c*) out of the outdoor unit (20) and then flows into the liquid connection pipe (13). Part of the refrigerant in the liquid connection pipe (13) flows through the branch liquid connection pipe (16) into the second BS unit (30B), and the rest flows into the first BS unit (30A).

In each of the first and second BS units (30A, 30B), part of the refrigerant flowing through the liquid pipe (40) flows into the supercooling pipe (52), and the rest passes through the supercooling heat exchanger (51) and then flows into the first or second indoor unit (40A, 40B).

In the course of the above flow of refrigerant, the liquid refrigerant having flowed into the supercooling pipe (52) is reduced in pressure by the supercooling control valve (53), and then passes through the supercooling heat exchanger (51). In the supercooling heat exchanger (51), the liquid refrigerant flowing through the supercooling pipe (52) exchanges heat with the liquid refrigerant flowing through the liquid pipe (40) to evaporate. The refrigerant having evaporated flows into the low-pressure passage (39) and then returns to the compressor (21).

Thus, the liquid refrigerant flowing through the liquid pipe (40) is supercooled, whereby the liquid refrigerant having been in a gas-liquid two-phase state is fully liquefied and turned into liquid refrigerant having a high cooling capacity. Even when flowing into the indoor heat exchanger (41), the liquid refrigerant does not cause refrigerant flow sound.

In each of the first indoor unit (40A) and the second indoor unit (40B), the refrigerant is reduced in pressure by the indoor expansion valve (42) and then flows into the indoor heat exchanger (41). In the indoor heat exchanger (41), the refrigerant exchanges heat with the air taken in by the indoor fan (43) to evaporate. Thus, the air is cooled, thereby cooling the room. Then, the gas refrigerant obtained by evaporation in the indoor heat exchanger (41) flows out of the associated indoor unit (40A, 40B) and then through the intermediate connection pipe (17) into the associated BS unit (30A, 30B).

In the first BS unit (30A), the gas refrigerant flows through the intermediate connection pipe (17) into the low-pressure gas connection pipe (12). In the second BS unit (30B), the gas refrigerant flows through the intermediate connection pipe (17) into the branch low-pressure gas connection pipe (15). Then, the gas refrigerant flows into the low-pressure gas connection pipe (12). The gas refrigerant in the low-pressure gas connection pipe (12) flows into the outdoor unit (20), and returns through the suction pipe (2*b*) to the compressor (21). The refrigerant repeats this circulation.

-Supercooling Operation in Cooling Operation-

Next will be described the supercooling operation for supercooling the liquid refrigerant flowing through the liquid connection pipe (13) (or the branch liquid connection pipe (16)) constituting the liquid pipe (40) of each of the first and second BS units (30A, 30B). FIG. 1 shows the operation in which both the first and second indoor units (40A, 40B) cool rooms. Therefore, the supercooling operation in each of the first and second BS units (30A, 30B) is carried out according to the air conditioning load of the indoor heat exchanger (41) connected to the associated BS unit (30A, 30B).

The air conditioning load varies when a plurality of indoor units (40A, 40B) are connected to one BS unit (30A, 30B) and the indoor units (40A, 40B) are individually turned on or off, and varies depending upon the ambient temperature around the utilization side heat exchanger (41) and the preset temperature in the cooling operation. Therefore, it is preferable to flexibly set the supercooling temperature according to the air conditioning load.

Figure 5:
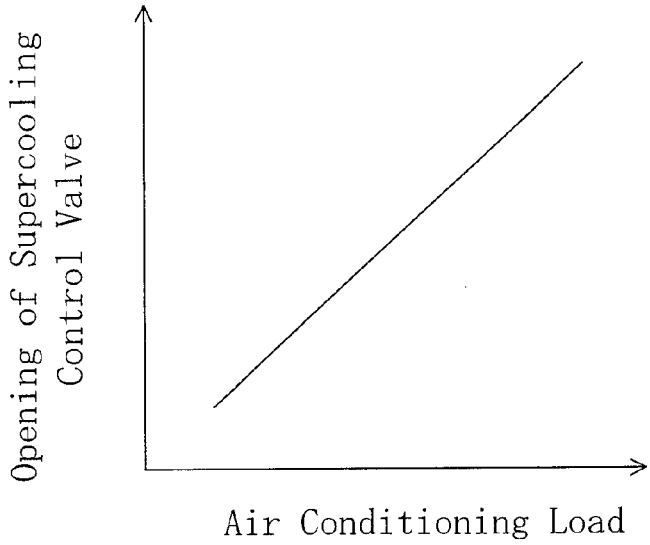
FIG. 5 is a graph showing the relation between air conditioning load and opening of a supercooling control valve.

Specifically, the control is implemented so that, as shown in FIG. 5, as the air conditioning load of the indoor heat exchanger (41) performing a cooling operation increases, the opening of the associated supercooling control valve (53) is increased, i.e., the amount of liquid refrigerant flowing through the liquid pipe (40) into the supercooling pipe (52) is increased.

When the first indoor unit (40A) has a larger air conditioning load than the second indoor unit (40B), the opening of the supercooling control valve (53) in the first BS unit (30A) is controlled to be larger than the opening of the supercooling control valve (53) in the second BS unit (30B). Thus, the amount of refrigerant flowing through the supercooling pipe (52) in the first BS unit (30A) is increased and, as a result, the degree of supercooling of liquid refrigerant flowing through the liquid pipe (40) is increased. This is advantageous in ensuring the required cooling capacity of the first indoor unit (40A).

In addition, since the first and second BS units (30A, 30B) individually supercool liquid refrigerant flowing through their liquid pipes (40), liquid refrigerant in a gas-liquid two-phase state does not flow into the indoor heat exchangers (41, 41) of the first and second indoor units (40A, 40B) performing cooling operations. This is advantageous in preventing the occurrence of refrigerant flow sound.

<Heating Operation>

Figure 2:
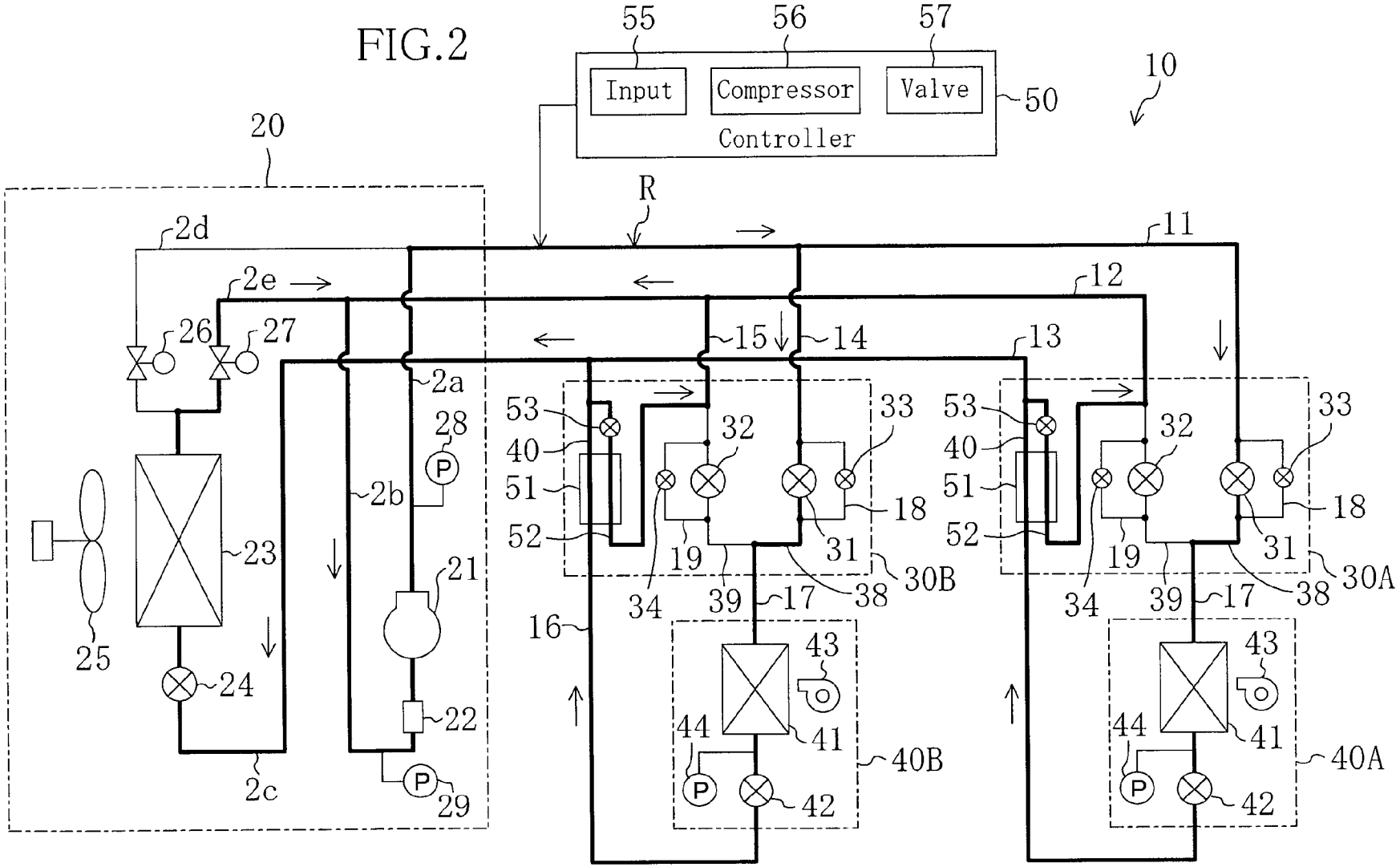
FIG. 2 is a refrigerant circuit diagram showing the performance of a heating operation.

With reference to FIG. 2, next will be described the operation in which both of the first indoor unit (40A) and the second indoor unit (40B) heat rooms. In this heating operation, in the outdoor unit (20), the first solenoid valve (26) is set to a closed position, the second solenoid valve (27) is set to an open position, and the outdoor expansion valve (24) is set to an appropriate opening. In each BS unit (30A, 30B), the first control valve (31) is set to an open position, and the second control valve (32) and the first and second sub-control valves (33, 34) are set to closed positions. In each indoor unit (40A, 40B), the indoor expansion valve (42) is set to a fully open position.

When the compressor (21) is driven under the above conditions, high-pressure gas refrigerant discharged from the compressor (21) flows out of the outdoor unit (20), and flows into the high-pressure gas connection pipe (11). Part of the refrigerant in the high-pressure gas connection pipe (11) flows through the branch high-pressure gas connection pipe (14) into the second BS unit (30B), and the rest flows into the first BS unit (30A). The refrigerant having flowed in each of the BS units (30A, 30B) flows through the intermediate connection pipe (17) into the associated indoor unit (40A, 40B).

In each of the first and second BS units (30A, 30B), part of the refrigerant flowing through the liquid pipe (40) flows into the supercooling pipe (52), and the rest passes through the supercooling heat exchanger (51).

In the course of the above flow of refrigerant, the liquid refrigerant having flowed into the supercooling pipe (52) is reduced in pressure by the supercooling control valve (53), and then passes through the supercooling heat exchanger (51). In the supercooling heat exchanger (51), the liquid refrigerant flowing through the supercooling pipe (52) exchanges heat with the liquid refrigerant flowing through the liquid pipe (40) to evaporate. The refrigerant having evaporated flows into the low-pressure passage (39) and then returns to the compressor (21).

Thus, the liquid refrigerant flowing through the liquid pipe (40) is supercooled, whereby the liquid refrigerant having been in a gas-liquid two-phase state is fully liquefied and turned into liquid refrigerant having a high cooling capacity. Even when flowing into the indoor heat exchanger (41), the liquid refrigerant does not cause refrigerant flow sound.

In each indoor unit (40A, 40B), the refrigerant exchanges heat with the air to condense. Thus, the air is heated, thereby heating the room. The refrigerant having condensed in the first indoor unit (40A) flows into the liquid connection pipe (13). The refrigerant having condensed in the second indoor unit (40B) flows through the branch liquid connection pipe (16) into the liquid connection pipe (13). The refrigerant in the liquid connection pipe (13) flows into the outdoor unit (20) and flows through the main pipe (2*c*). The refrigerant in the main pipe (2*c*) is reduced in pressure by the outdoor expansion valve (24), and then flows into the outdoor heat exchanger (23). In the outdoor heat exchanger (23), the refrigerant exchanges heat with the air to evaporate. The gas refrigerant obtained by evaporation flows through the second branch pipe (2*e*) and the suction pipe (2*b*), and then returns to the compressor (21). The refrigerant repeats this circulation.

-Supercooling Operation in Heating Operation-

Next will be described the supercooling operation for supercooling the liquid refrigerant flowing through the liquid connection pipe (13) (or the branch liquid connection pipe (16)) constituting the liquid pipe (40) of each of the first and second BS units (30A, 30B). FIG. 2 shows the operation in which both the first and second indoor units (40A, 40B) heat rooms. Therefore, the supercooling operation in each of the first and second BS units (30A, 30B) is carried out according to the air conditioning load of the outdoor heat exchanger (23).

In this case, the control is implemented so that as the air conditioning load of the outdoor heat exchanger (23) increases, the openings of the supercooling control valves (53) in the first and second BS units (30A, 30B) are increased, i.e., the amounts of liquid refrigerant flowing through the liquid pipes (40) into the supercooling pipes (52) are increased.

Since in this manner the first and second BS units (30A, 30B) individually supercool liquid refrigerant flowing through their liquid pipes (40), liquid refrigerant in a gas-liquid two-phase state does not flow into the outdoor heat exchanger (23). This is advantageous in preventing the occurrence of refrigerant flow sound.

<Cooling and Heating Operation>

Next will be described the operation in which one of the indoor units (40A, 40B) cools a room and the other indoor unit (40A, 40B) heats a room.

There will first be explained the operation in which the first indoor unit (40A) cools a room and the second indoor unit (40B) heats a room (hereinafter referred to as "Cooling and Heating Operation 1"). Note that only different points from the above cooling operation will be described here.

Figure 3:
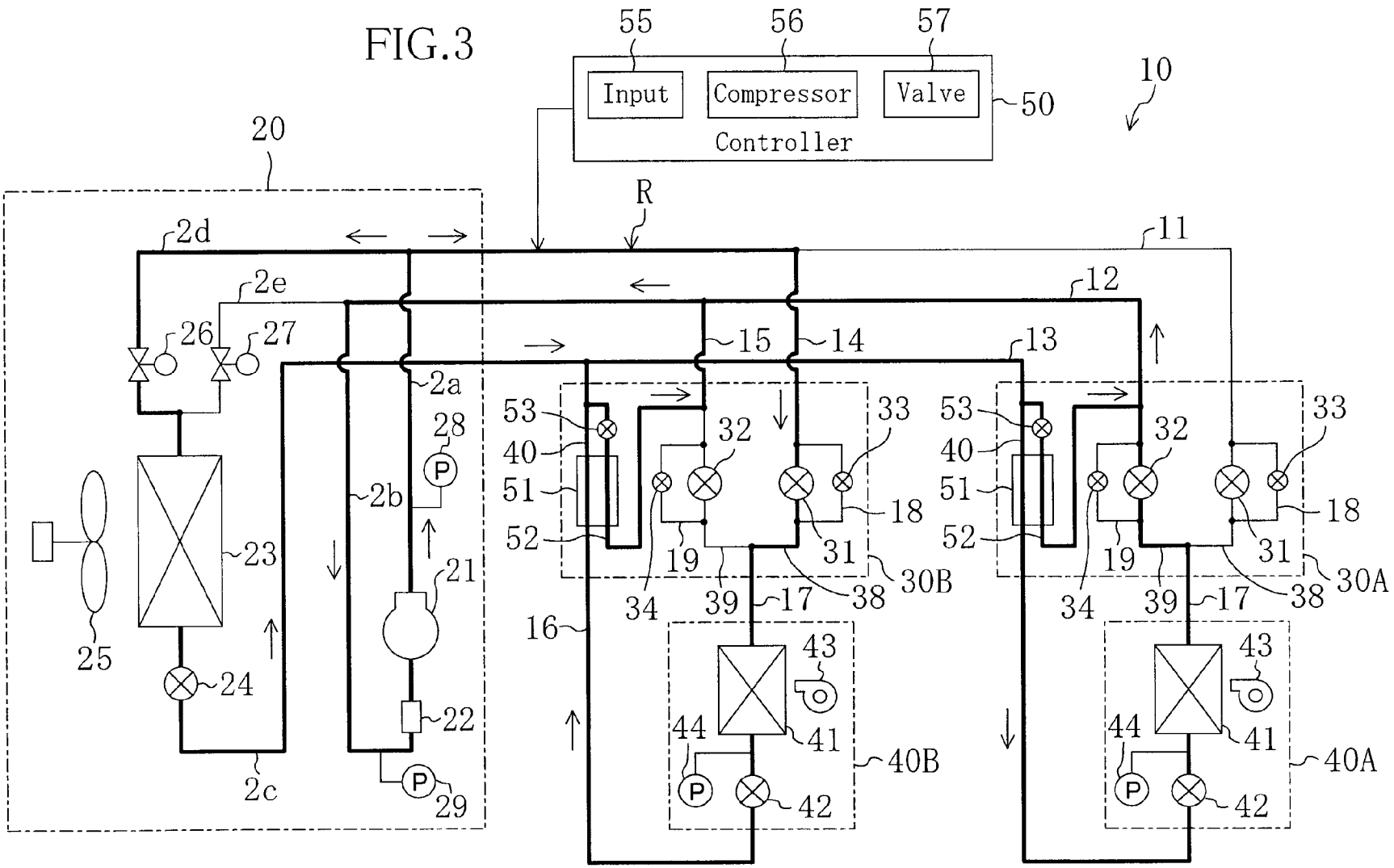
FIG. 3 is a refrigerant circuit diagram showing the performance of Cooling and Heating Operation 1.

In Cooling and Heating Operation 1, as shown in FIG. 3, under the above-described conditions of the cooling operation, the first control valve (31) of the second BS unit (30B) is set to an open position, and the second control valve (32) and the first and second sub-control valves (33, 34) of the same are set to closed positions. Furthermore, the indoor expansion valve (42) of the second indoor unit (40B) is set to a fully open position. Thus, part of the high-pressure gas refrigerant discharged from the compressor (21) flows into the first branch pipe (2*d*), and the rest flows into the high-pressure gas connection pipe (11).

The refrigerant having flowed into the high-pressure gas connection pipe (11) flows through the branch high-pressure gas connection pipe (14) into the second BS unit (30B), and then flows through the intermediate connection pipe (17) into the indoor heat exchanger (41) of the second indoor unit (40B).

In the indoor heat exchanger (41) of the second indoor unit (40B), the refrigerant exchanges heat with the air to condense. Thus, the air is heated, thereby heating the room.

The refrigerant having condensed in the second indoor unit (40B) flows through the branch liquid connection pipe (16) into the liquid pipe (40) of the second BS unit (30B). In the second BS unit (30B), part of the refrigerant flowing through the liquid pipe (40) flows into the supercooling pipe (52), and the rest flows through the supercooling heat exchanger (51) into the liquid connection pipe (13).

In the course of the above flow of refrigerant, the liquid refrigerant having flowed into the supercooling pipe (52) is reduced in pressure by the supercooling control valve (53), and then passes through the supercooling heat exchanger (51). In the supercooling heat exchanger (51), the liquid refrigerant flowing through the supercooling pipe (52) exchanges heat with the liquid refrigerant flowing through the liquid pipe (40) to evaporate. The refrigerant having evaporated flows into the low-pressure passage (39) and then returns to the compressor (21).

Thus, the liquid refrigerant flowing through the liquid pipe (40) is supercooled, whereby the liquid refrigerant having been in a gas-liquid two-phase state is fully liquefied and turned into liquid refrigerant having a high cooling capacity. Even when flowing into the indoor heat exchanger (41) of the first indoor unit (40A), the liquid refrigerant does not cause refrigerant flow sound.

The refrigerant having flowed into the liquid connection pipe (13) joins the refrigerant coming from the outdoor unit (20). The refrigerant thus joined flows through the liquid connection pipe (13) as its is, and then evaporates in the indoor unit (40A). Thus, the room is cooled.

There will next be explained the operation in which the first indoor unit (40A) heats a room and the second indoor unit (40B) cools a room (hereinafter referred to as "Cooling and Heating Operation 2"). Note that only different points from the above heating operation will be described here.

Figure 4:
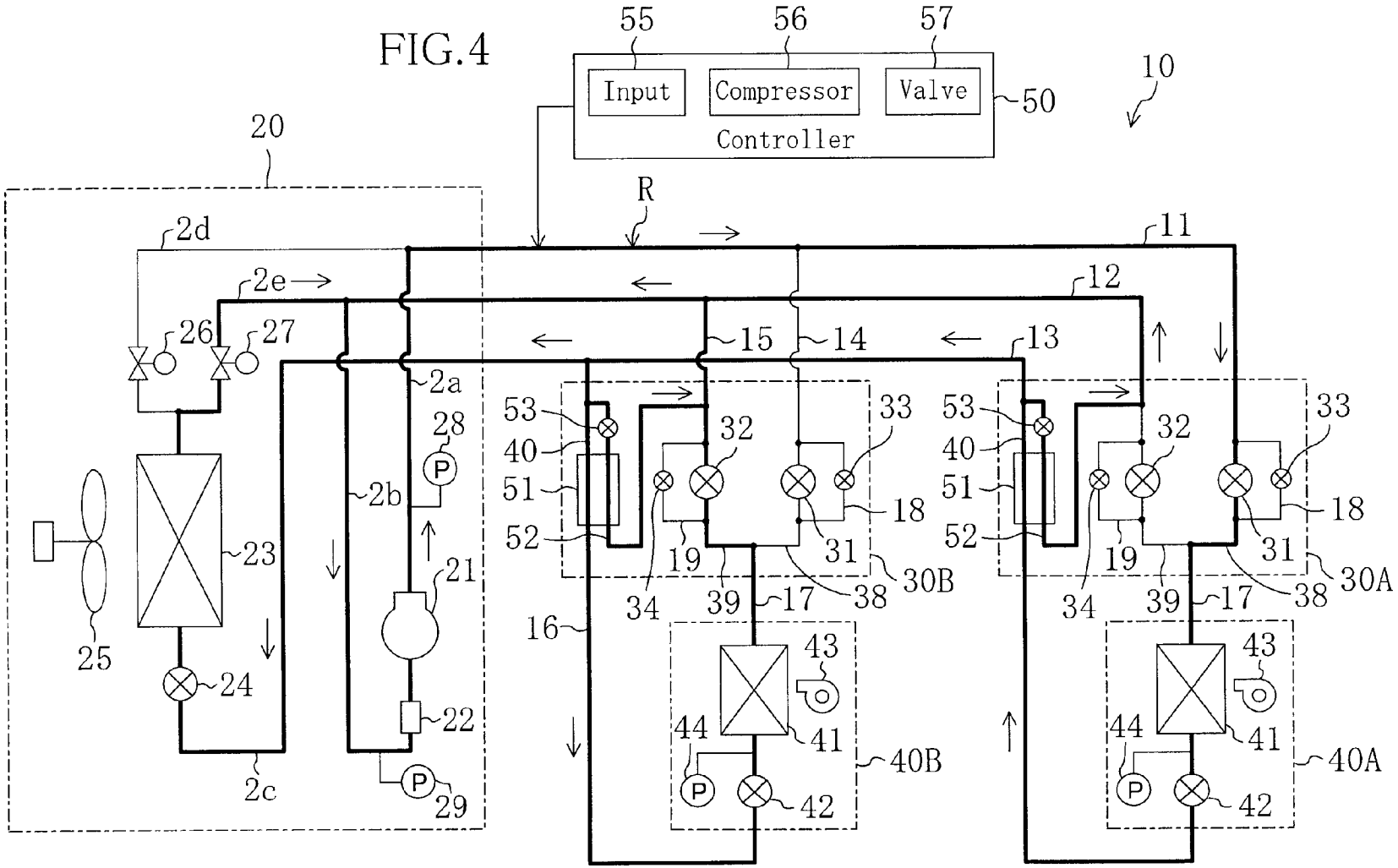
FIG. 4 is a refrigerant circuit diagram showing the performance of Cooling and Heating Operation 2.

In Cooling and Heating Operation 2, as shown in FIG. 4, under the above-described conditions of the heating operation, the first control valve (31) and the first and second sub-control valves (33, 34) of the second BS unit (30B) are set to closed positions, and the second control valve (32) of the same is set to an open position. Furthermore, the indoor expansion valve (42) of the second indoor unit (40B) is set to an appropriate opening. Thus, all of the refrigerant having flowed from the compressor (21) into the high-pressure gas connection pipe (11) flows into the first BS unit (30A). The refrigerant having flowed through the first BS unit (30A) flows into the first indoor unit (40A) to condense therein. Thus, a heating operation is carried out in the first indoor unit (40A).

The refrigerant having condensed in the first indoor unit (40A) flows through the liquid connection pipe (13) into the liquid pipe (40) of the first BS unit (30A). In the first BS unit (30A), part of the refrigerant flowing through the liquid pipe (40) flows into the supercooling pipe (52), and the rest flows through the supercooling heat exchanger (51) into the liquid connection pipe (13).

In the course of the above flow of refrigerant, the liquid refrigerant having flowed into the supercooling pipe (52) is reduced in pressure by the supercooling control valve (53), and then passes through the supercooling heat exchanger (51). In the supercooling heat exchanger (51), the liquid refrigerant flowing through the supercooling pipe (52) exchanges heat with the liquid refrigerant flowing through the liquid pipe (40) to evaporate. The refrigerant having evaporated flows into the low-pressure passage (39) and then returns to the compressor (21).

Thus, the liquid refrigerant flowing through the liquid pipe (40) is supercooled, whereby the liquid refrigerant having been in a gas-liquid two-phase state is fully liquefied and turned into liquid refrigerant having a high cooling capacity. Even when flowing into the indoor heat exchanger (41) of the second indoor unit (40B), the liquid refrigerant does not cause refrigerant flow sound.

Part of the refrigerant having flowed into the liquid connection pipe (13) flows through the branch liquid connection pipe (16) into the second indoor unit (40B), and the rest flows into the outdoor unit (20). In the second indoor unit (40B), the refrigerant is reduced in pressure by the indoor expansion valve (42) and then evaporates in the indoor heat exchanger (41). Thus, a cooling operation is carried out in the second indoor unit (40B).

The gas refrigerant obtained by evaporation in the second indoor unit (40B) flows through the intermediate connection pipe (17), the second BS unit (30B) and the branch low-pressure gas connection pipe (15) in this order, and then flows into the low-pressure gas connection pipe (12). The refrigerant in the low-pressure gas connection pipe (12) flows into the second branch pipe (2*e*) of the outdoor unit (20), and joins the refrigerant coming from the outdoor heat exchanger (23). The refrigerant thus joined flows through the suction pipe (2*b*), and returns to the compressor (21).

-Supercooling Operation in Cooling and Heating Operation-

Next will be described the supercooling operation for supercooling the liquid refrigerant flowing through the liquid connection pipe (13) (or the branch liquid connection pipe (16)) constituting the liquid pipe (40) of each of the first and second BS units (30A, 30B). FIG. 3 shows Cooling and Heating Operation 1 in which the first indoor unit (40A) cools a room and the second indoor unit (40B) heats a room. Therefore, the supercooling operation in each of the first and second BS units (30A, 30B) is carried out according to the air conditioning load of the indoor heat exchanger (41) of the first indoor unit (40A).

In this case, the control is implemented so that as the air conditioning load of the indoor heat exchanger (41) performing a cooling operation increases, the openings of the supercooling control valves (53) in the first and second BS units (30A, 30B) are increased, i.e., the amounts of liquid refrigerant flowing through the liquid pipes (40) into the supercooling pipes (52) are increased.

Since in this manner the first and second BS units (30A, 30B) individually supercool liquid refrigerant flowing through their liquid pipes (40), liquid refrigerant in a gas-liquid two-phase state does not flow into the indoor heat exchanger (41) of the first indoor unit (40A) performing a cooling operation. This is advantageous in preventing the occurrence of refrigerant flow sound.

On the other hand, FIG. 4 shows Cooling and Heating Operation 2 in which the first indoor unit (40A) heats a room and the second indoor unit (40B) cools a room. Therefore, the supercooling operation in each of the first and second BS units (30A, 30B) is carried out according to the air conditioning load of the indoor heat exchanger (41) of the second indoor unit (40B).

In this case, the control is implemented so that as the air conditioning load of the indoor heat exchanger (41) performing a cooling operation increases, the openings of the supercooling control valves (53) in the first and second BS units (30A, 30B) are increased, i.e., the amounts of liquid refrigerant flowing through the liquid pipes (40) into the supercooling pipes (52) are increased.

Since in this manner the first and second BS units (30A, 30B) individually supercool liquid refrigerant flowing through their liquid pipes (40), liquid refrigerant in a gas-liquid two-phase state does not flow into the indoor heat exchanger (41) of the second indoor unit (40B) performing a cooling operation. This is advantageous in preventing the occurrence of refrigerant flow sound.

<Other Embodiments>

The above embodiment may have the following configurations.

Figure 6:
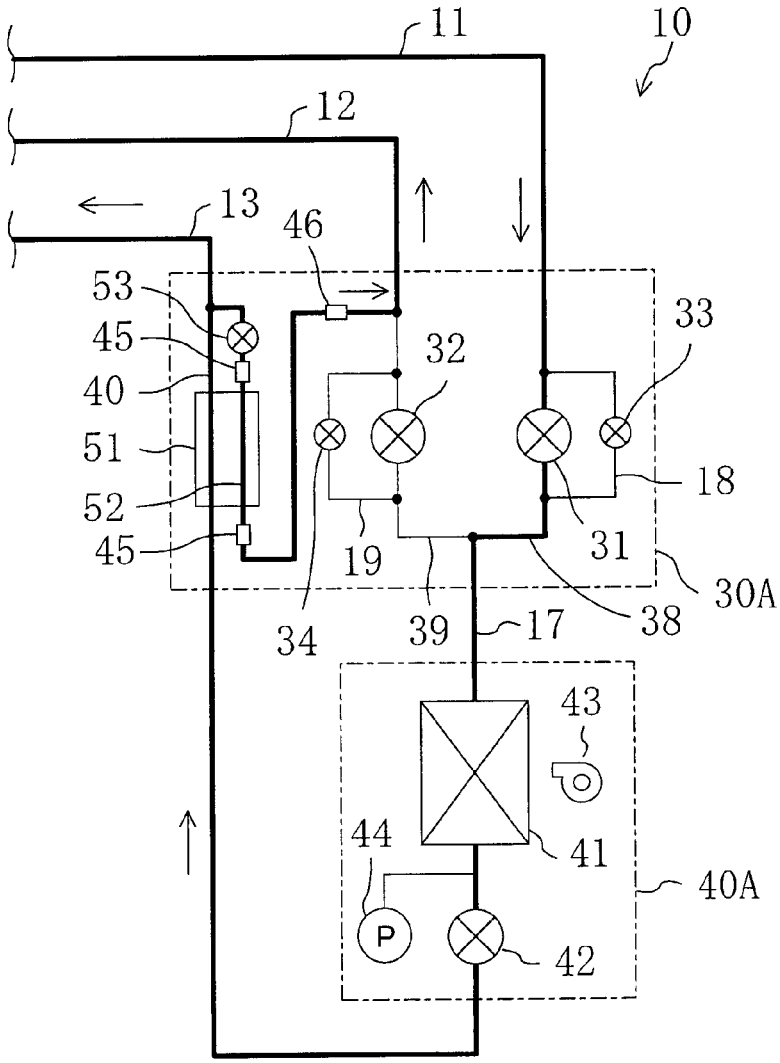
FIG. 6 is another refrigerant circuit diagram partly broken away.

For example, as shown in FIG. 6, in the air conditioner (10) of the above embodiment, two temperature sensors (45, 45) may be provided as temperature detection means, one upstream of the supercooling heat exchanger (51) and the other downstream of the same, and the opening of the supercooling control valve (53) may be adjusted according to the detected values of the temperature sensors (45, 45).

In this case, the refrigerant flow rate is controlled by detecting the temperatures at the entrance and exit of the supercooling heat exchanger (51), and appropriately adjusting the opening of the supercooling control valve (53) to provide a temperature difference with which the liquid refrigerant diverted from the liquid pipe (40) into the supercooling pipe (52) can surely evaporate in the supercooling heat exchanger (51).

This is advantageous in preventing that the liquid refrigerant flowing through the supercooling pipe (52) cannot fully evaporate in the supercooling heat exchanger (51) and thereby turns into a gas-liquid two-phase state, and that in turn the refrigerant in a gas-liquid two-phase state flows into the compressor (21) to burn out the compressor (21).

Furthermore, the refrigerant flow rate is controlled by appropriately adjusting the opening of the supercooling control valve (53) based on the detected value of the temperature sensor (45) downstream of the supercooling heat exchanger (51) and the detected value of a pressure sensor (46) downstream of the temperature sensor (45) so that the liquid refrigerant can surely evaporate in the supercooling heat exchanger (51).

Although the above embodiment has been described in relation to the configuration including two indoor units (40A, 40B) and two BS units (30A, 30B), it will be appreciated that a configuration including three or more indoor units and three or more BS units likewise could suppress the occurrence of refrigerant flow sound.

Although the above embodiment has been described in relation to the configuration in which each of the BS units (30A, 30B) is connected to a single indoor unit (40A, 40B), the present invention may also be applied to a configuration in which each of the BS units (30A, 30B) is connected to a plurality of indoor units (40A, 40B).

Industrial Applicability

As can be seen from the above description, the present invention provides a highly practical effect of ensuring the air conditioning performance of the air conditioner as a whole while suppressing refrigerant flow sound due to occurrence of a flash of refrigerant.

Therefore, the present invention is very useful and has a high industrial applicability.

The invention claimed is:

1. An air conditioner including a high-pressure gas connection pipe, a low-pressure gas connection pipe, a liquid connection pipe, and a plurality of utilization side heat exchangers, one end of each of the utilization side heat exchangers being connected through a liquid pipe of a switching mechanism and an expansion mechanism to the liquid connection pipe, the other end of each of the utilization side heat exchangers being connected through the switching mechanism to the high-pressure gas connection pipe and the low-pressure gas connection pipe to be switchable between both the gas connection pipes, each of the utilization side heat exchangers being capable of performing a cooling operation and a heating operation individually, wherein each of the switching mechanisms comprises:

a supercooling heat exchanger for supercooling liquid refrigerant flowing through the liquid pipe;

a supercooling pipe connected at one end to the liquid pipe, passing through the supercooling heat exchanger and connected at the other end to the low-pressure gas connection pipe; and a supercooling control valve disposed in the supercooling pipe between the one end of the supercooling pipe and the supercooling heat exchanger and being adjustable in opening, and the switching mechanism connected to a first of the utilization side heat exchangers, performing a heating operation, is configured so that the opening of the supercooling control valve is adjusted according to the air conditioning load of a second of the utilization side heat exchangers, performing a cooling operation, downstream of the liquid connection pipe connected to the first of the utilization side heat exchangers.

2. The air conditioner of claim 1, wherein the switching mechanism connected to the second of the utilization side heat exchangers, performing a cooling operation, is configured so that the opening of the supercooling control valve is adjusted according to the air conditioning load of the second of the utilization side heat exchangers.

3. The air conditioner of claim 1, further including a temperature detection means configured to detect the temperature of refrigerant in the supercooling pipe downstream of the supercooling heat exchanger, wherein each of the switching mechanisms is configured so that the opening of the supercooling control valve is adjusted according to the detected value of the temperature detection means.

* * * * *